US005152872A

United States Patent [19]

Racine et al.

[11] Patent Number: 5,152,872

[45] Date of Patent: Oct. 6, 1992

[54] APPARATUS FOR THE WET END COATING OF PAPER

[75] Inventors: Jean-Guy Racine, St-Boniface; Michel Fournier, Grand Mère, both of Canada

[73] Assignee: Stone-Consolidated Inc., Montreal, Canada

[21] Appl. No.: 597,315

[22] Filed: Oct. 15, 1990

[51] Int. Cl.[5] ..... D21H 23/28

[52] U.S. Cl. ..... 162/184; 162/186; 162/265; 162/266

[58] Field of Search ..... 162/184, 185, 186, 265, 162/266

[56] References Cited

U.S. PATENT DOCUMENTS

| | | | |
|---|---|---|---|
| 1,025,822 | 5/1912 | Millspaugh | 162/266 |
| 1,964,567 | 6/1934 | Feeney | 162/184 |
| 2,214,772 | 9/1940 | Muggleton | 162/186 |
| 2,772,604 | 12/1956 | Muggleton | 162/184 |
| 2,920,698 | 1/1960 | Hornbostel | 162/265 |
| 3,214,328 | 10/1965 | Muggleton | 162/186 |
| 3,271,238 | 9/1966 | Bescher | 162/266 |
| 3,560,334 | 2/1971 | Arledter | 162/266 |

*Primary Examiner*—Peter Chin

[57] ABSTRACT

An apparatus for wet-end coating a web on a papermachine before the web enters the dryer comprises a first endless porous fabric passing around a first couch roll equipped with a suction box. As the web passes around the first couch roll, a first applicator applies a coating on a top side of the web with the first suction box drawing some of the coating color onto and through the web so as to coat the top side thereof. The web is then conveyed on a second endless porous fabric which passes around a second couch roll equipped with a second suction box. In this case, the top side of the web is in contact with the second porous fabric so that a second applicator may apply coating color on the bottom side of the web with the second suction box, as above, drawing some of the coating color onto and through the wet web for coating the bottom side thereof. The applicators may be rolls which contact the web. Recovery systems may be provided for returning the coating color recuperated by the suction boxes to the applicator rolls. Coating, bonding agents, bleaching agents and various other substances including dry substances that can enhance the various properties of the paper or paperboard may be applied by the above applicators.

36 Claims, 1 Drawing Sheet

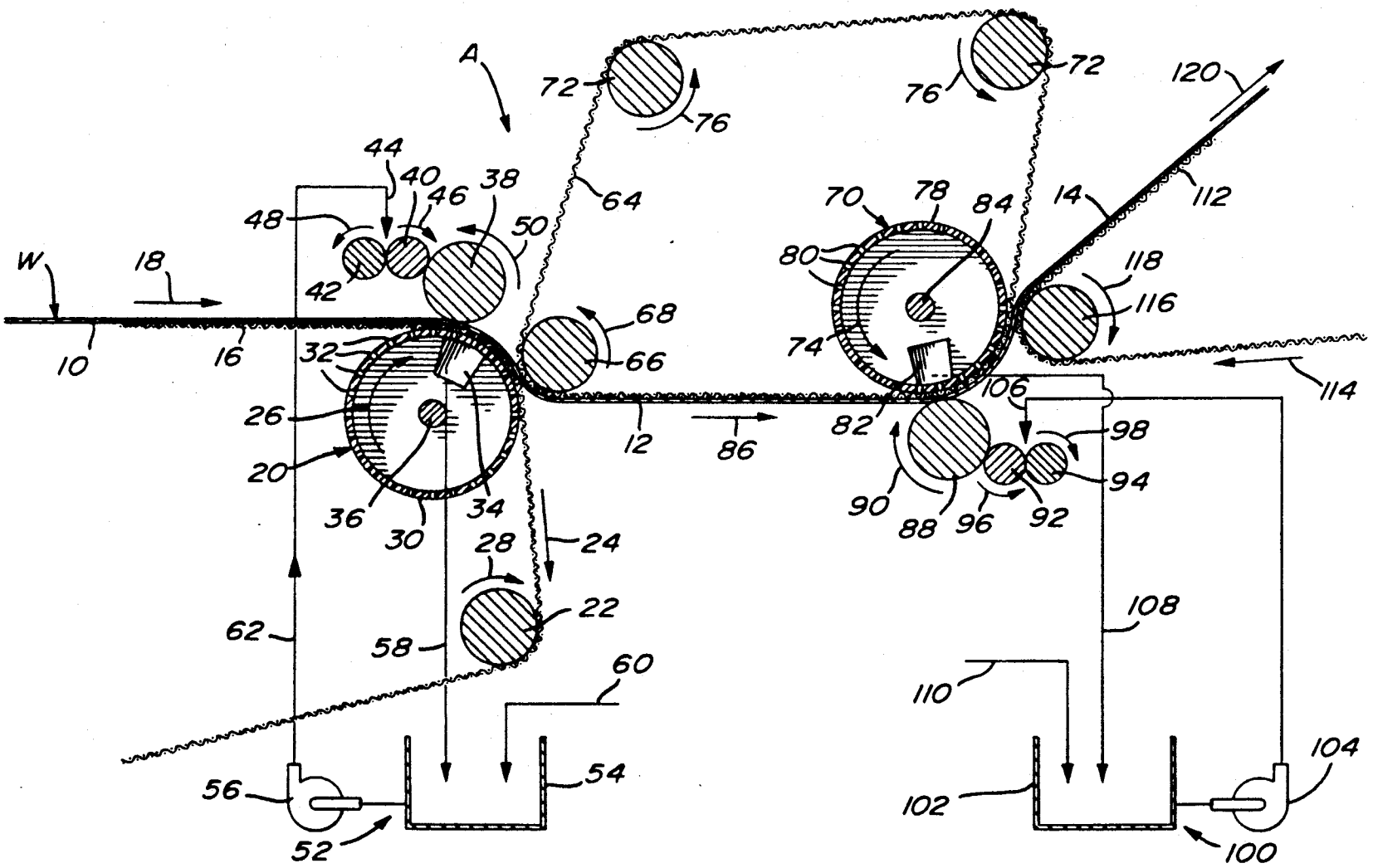
A
W
10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102
104
106
108
110
112
114
116
118
120

APPARATUS FOR THE WET END COATING OF PAPER

BACKGROUND OF THE INVENTION

1. Field of the Invention

The present invention relates to apparatuses for coating paper and, more particularly, to such an apparatus for coating the web at the wet end of the papermachine.

2. Description of the Prior Art

Originally, practically all paper coating was carried out off-machine, that is as a completely separate operation which is not effected on the papermachine as opposed to on-machine coating which constitutes a step executed directly on the paper-machine. Such off-machine paper coating apparatuses obviously resulted in a costly operation requiring expensive equipment.

Later, on-machine coating proved feasible although it was performed on the web after the web had entered the dryer section and had been partially dried thereby. Probably the least costly on-machine coating method was based on size press coating performed on a papermachine having a size press located well within the dryer section. However, using such a size press for coating meant that water was being added to the web after most of the water had already been driven off by the dryer itself. Furthermore, the press itself limited the range of coating weights and materials. While a few wet end coating methods have been proposed, none have found commercial success as they did not perform well or were to costly.

Moreover, coating was generally reserved for paper products that could command a fairly high market price. Newsprint was not such a product. In addition, public demand that more recycled fibers be used in the manufacture of newsprint increased. In response, the publishers recently passed this demand onto the newsprint producers. Unfortunately, the use of recycled fibers tends to lead to increased linting. An inexpensive newsprint coating method would not only solve the linting problem but would also improve various paper properties as well as the overall quality of the printing. One such property would reside in opacity which in turn would allow for the use of less expensive fiber furnishes.

SUMMARY OF THE INVENTION

It is therefore an aim of the present invention to provide an apparatus for wet end on-machine paper coating.

It is also an aim of the present invention to provide such a coating apparatus adapted to apply to the surface of the web a wide variety of substances.

A construction in accordance with the present invention comprises an apparatus on a papermachine for applying a substance to a wet paper web. The apparatus comprises a first web conveying porous fabric means on which the web is deposited. The first fabric means passes around a first couch roll means provided with a first suction box means. A first applicator means is located on a first side of the web opposite a second side thereof contacting the first fabric means for applying the substance to the web. The first suction box means is located relative to the first applicator means in order to draw the substance at least onto the web. Therefore, the web emerges from the apparatus with at least some of the substance that was applied thereto.

A method in accordance with the present invention for applying a substance on a wet paper web on a papermachine comprises the following steps:

a) depositing the web on a first web conveying porous fabric means which passes around a first couch roll means provided with a first suction box means;

b) conveying the web between the first couch roll means and a first applicator means located on a first side of the web opposite a second side thereof contacting the first fabric means;

c) applying on the web the substance by way of the first applicator means with the first suction box means drawing the substance at least onto the web; and d) conveying the web away from the first couch roll means with the web retaining at least some of the substance that was applied thereto.

While a primary object of the present invention resides in applying somewhat conventional coating colors to the wet web during the stages when liquid water can still be removed from the web by non-evaporative means, the present invention is not limited to the coating or to the application of coating color to the web. Indeed, the nature of the invention allows for the coating and/or application to the surface of the web of a wide variety of substances, which are drawn onto and into the web by suction and/or pressing. For instance, bonding agents, bleaching agents and various other substances that can enhance the various properties of the paper or paperboard may be applied by way of the present invention to the web, whereby it is considered that the present invention is very versatile.

BRIEF DESCRIPTION OF THE DRAWINGS

Having thus generally described the nature of the invention, reference will now be made to the accompanying single drawing showing by way of illustration a preferred embodiment thereof and, more particularly, a cross-sectional side elevation illustrating an apparatus in accordance with the present invention.

DESCRIPTION OF THE PREFERRED EMBODIMENTS

Referring to the accompanying drawing, a web generally indicated by W is fed throughout an apparatus A embodying the present invention. Throughout the apparatus A, the web W evolves from a first state to a second state and finally to a third state respectively indicated by the numerals 10, 12 and 14.

The first web 10 is the result of conventional methods of and apparatuses for depositing a suspension of fibers and water which are well known and thus need not to be herein described in details. Generally, in the older papermachines, the suspension is deposited on a single, porous endless fabric. In more recent papermachines, the suspension is deposited on and between two such porous fabrics with one of them separating from the other once the web has stabilized and carrying the formed wet web around a part of the periphery of the couch roll. This latter method is commonly referred to as the "twin-wire" method for the forming of paper.

Referring to the enclosed drawing, the first web section 10 represents a formed wet web resulting from such a twin-wire forming of paper and being carried by a single or final porous endless fabric 16, which will be hereinafter referred to as the first endless fabric 16, towards the apparatus A along the direction shown by arrow 18.

The first endless fabric 16 passes around a first couch roll 20 and a first return roll 22 along the direction shown by arrow 24 as the first couch and return rolls 20 and 22 rotate in the directions shown respectively by arrows 26 and 28. (The first return roll 22 can also be in some machine a fabric drive roll or turning roll. Complementary guide, wash, stretch, tension and/or breast rolls are not shown in the drawing to avoid complicating the illustration.)

The first couch roll 20 includes a cylindrical wall 30 defining a series of apertures 32 and a first suction box 34 disposed between the cylindrical wall 30 and a shaft 36 of the first couch roll 20.

The first web section 10 and the first endless fabric 16 pass between the first suction box 34 and a first coating applicator which is shown in the present embodiment as a coating roll 38 resting on the top side of the wet first web section 10 at a location with respect to the first suction box 34 that will ensure that, for a particular coating color, the right amount of color will be filtered out by the first web section 10 as it is drawn onto and through the web by and into the first suction box 34 because of the suction created thereby. Beside transferring the coating color to the first web section 10, the first coating applicator 38 can also serve to press down on the web and decrease its water content following the first suction box 34 drawing away any excess water pressed out by the first coating roll 38.

First coating metering and distributing rolls 40 and 42 receive, meter and distribute the coating color to the first coating roll 38. Where desired, the first metering and distributing rolls 40 and 42 can be replaced by other types of rolls, such as pick-up rolls and associated color pan and any other conventional device or method to meter and distribute the coating color to the first coating roll 38 (which is also commonly referred to as the "coating head").

Where heavier colors are to be used, various types of gate rolls, blade and brush coaters, air doctors, print (engraven) roll coaters, cast waters, etc. can be selected to apply, meter and distribute the colors directly to the surface of the wet web. For example, depending on the nature of the web and the papermachine, a different type of coater could be used for each of the two locations such as a roll applicator in one location and a blade or roll coater in the other. High speed machines may require the use of such coaters and, in particular, the print roll coater has been found to be effective.

Therefore, the coating color is supplied between the first metering and distributing rolls 40 and 42 as indicated by arrow 44, with the first metering and distributing rolls 40 and 42 rotating in the directions shown respectively by arrows 46 and 48, whereas the first coating roll 38 rotates along arrow 50. From the above, it is easily understood that the coating color will be applied on the top surface of the first web section 10 by the first coating roll 38.

In the case where it is desired to re-use any coating color that is recovered by the first suction box 34, a first coating color recovery system 52 is provided. The first recovery system 52 includes a first make-up tank 54, a first make-up supply (not shown) and a first return pump 56 which function as follows. The excess of coating color is recovered by the first suction box 34 and is transported therefrom to the first make-up tank 54 as indicated by arrow 58. A system of pipes (not shown) could be used to convey the excess coating color from the first suction box 34 to the first make-up tank 54. In order that the level of the coating color in the first make-up tank 54 remains constant, a supply of fresh coating color is supplied to the first make-up tank as indicated by arrow 60. The first return pump 56 can thus convey the coating color contained in the first make-up tank 54 to the first metering and distributing rolls 40 and 42 as indicated by arrow 62.

Alternatively, the coating color recovered by the first suction box 34 can be discarded and completely fresh coating color may be supplied to the first metering and distributing rolls 40 and 42. In fact, the first recovery system 52 may consist of several associated systems depending on the grade of paper or paper board, the coating color and the applicator. For example, where the white water volume or the percentage of fibers in the coating color recovered in the first suction box 34 is large, it may be necessary to set up a separate associated system to separate as much color as possible from the fibers in order that the recovered coating color can be made-up and returned to the first metering and distributing rolls 40 and 42. Similarly, the separated recovered fibers can be returned to the conventional white water and fiber recovery system of the papermachine. Prior art systems for such recycling are well known or can be easily developed. The system which will be used depends on many factors with the type and cost of the coating color being such prime factors.

Once the web W has passed the first suction box 34, it enters its second state and is then referred to as the second web section 12. The second web section 12 is picked-up at its top side by a second endless porous fabric 64 which passes between a pick-up roll 66 which rotates in the direction shown by arrow 68 and the web W. The pick-up roll 66 allows for the transfer of the top side coated wet web section 12 to the second endless fabric 64 so as to allow the subsequent coating of the underside of the web W as described hereinafter. The second endless fabric 64 further passes around a second couch roll 70 and a pair of second return or guide rolls 72 which rotate in the directions shown respectively by arrows 74 and 76.

The second couch roll 70 is similar to the first couch roll 20 and includes a cylindrical wall 78 defining a plurality of apertures 80 with a second suction box 82 being disposed within the second couch roll 70 between the cylindrical wall 78 and a shaft 84 thereof.

The second web section 12 is conveyed by the second endless fabric 64 as indicated by arrow 86 and passes between the second couch roll 70 and a second coating applicator which comprises a second coating roll 88 rotating in the direction shown by arrow 90. The second coating roll 88 is in contact with second metering and distributing rolls 92 and 94 which rotate in the directions shown respectively by arrows 96 and 98.

A second coating color recovery system 100 comprises a second make-up tank 102, a make-up supply (not shown) and a second return pump 104. It is noted that the second couch roll 70, the second suction box 82, the second coating roll 88, the second metering and distributing rolls 92 and 94 and the second recovery system 100 are respectively similar to the first couch roll 20, the first suction box 34, the first coating roll 38, the first metering and distributing rolls 40 and 42 and the first recovery system 52.

Again, coating color is supplied to the second metering and distributing rolls 92 and 94 along arrow 106 by way of the second return pump 104, with the coating color recovered by the second suction box 82 being conveyed along arrow 108 into the second make-up tank 102 which has a constant level due to the coating color make-up being further supplied therein from a remote source along arrow 110.

After the wet web W has been coated on both the top and bottom sides thereof, it is transferred on a third endless porous fabric 112 which displaces along arrow 114 and passes around a pick-up roll 116 which rotates in the direction shown by arrow 118. The third web section 14 thus displaces on the third endless fabric 112 along the direction shown by arrow 120.

The third web section 14 is then transferred to the press section by a further pick-up roll and a press felt, all of which are not shown. Following the press section, the coated web section 14 is conveyed through the dryer and the remaining sections of the papermachine.

It is noted that various devices for cleaning the surface of the coating rolls, prior to the application of the color, such as doctor blades, are not shown in the enclosed drawing.

The grade of paper to be manufactured and the type of papermachine being used will dictate to a large extent the type of coating applicator (i.e. coating rolls) and coating color that will be used. As mentioned hereinabove, for very high speed machines, it may be necessary to use some type of blade coaters. While there are numerous coating materials to choose from when coating a wet web of newsprint, the least expensive ones would be normally more desirable, e.g. clay, starch, calcium carbonate, and, if necessary, inexpensive adhesives, additives and dispersing agents would also be used. The type of coating color used, the paper being manufactured and its basis weight are some of the factors which could determine the location of the coating applicator with respect to the suction box in order that the right amount of coating color would be drawn on and into the web. Where necessary, the degree of vacuum in the suction box could also be controlled.

While the coating substance will generally be in a liquid form or state or in suspension in a liquid (e.g. a slurry), methods are known for applying substantially dry substances to a wet web, on the wire section before the first couch roll. One such method and coating apparatus involves an electrostatic technique. Where the wet web still has a relatively high water content such methods can be used in the present invention, especially at the first couch roll. In certain cases, some of the substance may even be drawn into the first suction box and recuperated in the white water. The material recovered may be used in suspension in a further application at the first or second couch roll or it may be dried and reused in the dry state.

Since most first fabrics are very porous, there would normally not be any need to change that fabric. On the other hand, where a pick-up felt was already in use on an existing machine, it would have to be changed to a more porous fabric to serve as the second fabric or a space should be provided to install the second fabric and the couch roll.

As mentioned hereinbefore, the versatility of the present invention allows one to apply any one or more of a large number of substances to the web for conventional coating and/or for other purposes. For example, bonding agents could be applied to give greater strength to the paper, bleaching agents could be applied to whiten the paper, various types of latexes, special chemical products (e.g. Aquapel, Aquamol, PVC, etc.) could be applied for known purposes.

While newsprint is highlighted above as one of the paper products suited for this invention, numerous other grades or products manufactured on papermachines can benefit from the present invention such as various specialty papers and paperboards, such as linerboards, etc.

Beside the energy saved due to the fact that it is not necessary in the present invention to evaporate the water before coating the web as required by other coating methods, that is those performed after water has been extracted as a liquid from the web (such as size press coating), other advantages accruing from the present invention will be obvious such as greater accessability to the coating apparatus, absence of the rejection phenomena, ease of addition to existing machines, low cost, etc.

We claim:

1. An apparatus on a papermachine for uniformly applying as a coat a substance to a wet paper web, comprising a first web conveying porous fabric means on which said web is deposited, said first fabric means passing around a first couch roll means provided with a first suction means for dewatering said web and comprising at least a fixed first suction box means operating under a controlled degree of suction, a first applicator means located on a first side of said web opposite a second side thereof contacting said first fabric means and adapted for uniformly applying the substance to said web, said first applicator means being located relative to said first suction means to ensure that, for a particular substance, the right amount of said substance will be filtered out by said web as it is drawn onto and through said web by and into said first suction means because of the controlled degree of suction in said first suction box means, whereby said web emerges from said apparatus with at least some of the substance that was applied thereto, and wherein a first transfer means is provided for transferring after said first couch roll means said web to a second web conveying porous fabric means with said first side of said web contacting said second fabric means, said second fabric means passing around a second couch roll means provided with a second suction means for dewatering said web and comprising at least a fixed second suction box means operating under a controlled degree of suction, a second applicator means being located on said second side of said web opposite said first side thereof contacting said second fabric means and adapted for uniformly applying the substance to said web, said second applicator means being located relative to said second suction means o ensure that the right amount of said particular substance will be filtered out by said web as it is drawn onto and through said web by and into said second suction means because of the controlled degree of suction in said second suction box means, whereby substance has been applied to said first and second sides of said web.

2. An apparatus as defined in claim 1, wherein some of the substance is drawn through said web by said first suction box means and is recuperated thereby, and wherein a first recovery means is provided for returning the substance recuperated by said first suction box means to said first applicator means.

3. An apparatus as defined in claim 2, wherein the substance is a liquid substance.

4. An apparatus as defined in claim 3, wherein said first recovery means comprises a first tank means, a first return pump means and first conduit means connecting said first suction box means to said first tank means, said first tank means to said first pump means and said first pump means to said first applicator means, said first tank means being further connected to an external supply of liquid substance.

5. An apparatus as defined in claim 1, wherein said first applicator means comprises a first applicator roll contacting said first side of said web, and a first metering and distributing means for supplying a desired amount of the substance to said first applicator roll.

6. An apparatus as defined in claim 5, wherein said first metering and distributing means comprises a first pair of parallel and horizontal rolls in contact with one another, with one of said first pair of rolls contacting said first applicator roll, a first conveying and supply means for delivering the substance to said first applicator means with the substance being supplied from the top in a first wedge-shaped channel formed by said first pair of rolls.

7. An apparatus as defined in claim 6, wherein the substance is a liquid substance.

8. An apparatus as defined in claim 1, wherein some of the substance is drawn through said web by said second suction box means and is recuperated thereby, and wherein a second recovery means is provided for returning the substance recuperated by said second suction box means to said second applicator means.

9. An apparatus as defined in claim 8, wherein the substance is a liquid substance.

10. An apparatus as defined in claim 9, wherein said second recovery means comprises a second tank means, a second return pump means and second conduit means connecting said second suction box means to said second tank means, said second tank means to said second pump means and said second pump means to said second applicator means, said second tank means being further connected to an external supply of liquid substance.

11. An apparatus as defined in claim 1, wherein said second applicator means comprises a second applicator roll contacting said second side of said web, and a second metering and distributing means for supplying a desired amount of the substance to said second applicator roll.

12. An apparatus as defined in claim 11, wherein said second metering and distributing means comprises a second pair of parallel and horizontal rolls in contact with one another, with one of said second pair of rolls contacting said second applicator roll, a second conveying and supply means for delivering the substance to said second applicator means with the substance being supplied from the top in a second wedge-shaped channel formed between said second pair of rolls.

13. An apparatus as defined in claim 12, wherein the substance is a liquid substance.

14. An apparatus as defined in claim 1, wherein said first transfer means comprises a pick-up roll with said second fabric means passing therearound, said pick-up roll being parallel to said first couch roll means and being located adjacent thereto in order that a plane passing substantially through the axes of said first couch roll means and said pick-up roll intersects said first and second fabric means and said web as said web is substantially tangential to said first and second fabric means when said web is being transferred from said first to said second fabric means.

15. An apparatus as defined in claim 14, wherein a second transfer means comprising a third web conveying porous fabric means is adapted for transferring thereto said web diverging from said second couch roll means in a way similar to the transfer of said web from said first to said second fabric means by way of said first transfer means.

16. An apparatus as defined in claim 15, wherein said first, second and third fabric means each form an endless web conveying means.

17. An apparatus as defined in claim 15, wherein the substance is a liquid coating, whereby said web is coated on both sides thereof with said coating.

18. A method for uniformly applying as a coat a substance to a wet paper web on a papermachine, comprising the steps of:

a) depositing said web on a first web conveying porous fabric means which passes around a first couch roll means provided with a first suction means for dewatering said web and comprising at least a fixed first suction box means operating under a controlled degree of suction;

b) conveying said web between said first couch roll means and a first applicator means located on a first side of said web opposite a second side thereof contacting said first fabric means and adapted for uniformly applying the substance to said web, said first applicator means being located relative to said first suction means to ensure that, for a particular substance, the right amount of said substance will be filtered out by said web as it is drawn onto and through said web by and into said first suction means because of the controlled degree of suction in said first suction box means;

c) applying on said web the substance by way of said first applicator means with said first suction box mans drawing the substance at least onto said web;

d) conveying said web away from said first couch roll means with said web retaining at least some of the substance that was applied thereto;

e) transferring by way of a first transfer means said web having passed said first couch roll means to a second web conveying porous fabric means with said first side of said web contacting said second fabric means which passes around a second couch roll means provided with a second suction means for dewatering said web and comprising at least a fixed second suction box means operating under a controlled degree of suction;

f) conveying said web between said second couch roll means and a second applicator means located on said second side of said web opposite said first side thereof contacting said second fabric means and adapted for uniformly applying the substance to said web, said second applicator means being located relative to said second suction means to ensure that the right amount of said particular substance will be filtered out by said web as it is drawn onto and through said web by and into said second suction means because of the controlled degree of suction in said second suction box means;

g) applying on said web the substance by way of said second applicator means with said second suction box means drawing the substance at least onto said web; and h) conveying said web away from said second couch roll means with the substance having been applied to said first and second sides of said web.

19. A method as defined in claim 18, wherein in step c, some of the substance is drawn through said web by said first suction box means and is recuperated thereby with the substance recuperated by said first suction box means being returned to said first applicator means by a first recovery means.

20. A method as defined in claim 19, wherein the substance is a liquid substance.

21. A method as defined in claim 20, wherein said first recovery means comprises a first tank means, a first return pump means and first conduit means connecting said first suction box means to said first tank means, said first tank means to said first pump means and said first pump means to said first applicator means, said first tank means being further connected to an external supply of liquid substance, whereby the liquid substance recuperated by said first suction box means is first conveyed into said first tank means with the external supply being adapted to maintain in said first tank means a constant level, the liquid substance being then conveyed by said first pump means from said first tank means to said first applicator means.

22. A method as defined in claim 18, wherein said first applicator means comprises a first applicator roll contacting said first side of said web, and a first metering and distributing means for supplying a desired amount of the substance to said first applicator roll.

23. A method as defined in claim 22, wherein said first metering and distributing means comprises a first pair of parallel and horizontal rolls in contact with one another, with one of said first pair of rolls contacting said first applicator roll, whereby the substance for said first applicator means is supplied from the top in a first wedge-shaped channel formed by said first pair of rolls.

24. A method as defined in claim 23, wherein the substance is a liquid substance.

25. A method as defined in claim 18, wherein in step g, some of the substance is drawn through said web by said second suction box means and is recuperated thereby with the substance recuperated by said second suction box means being returned to said second applicator means by a second recovery means.

26. A method as defined in claim 25, wherein the substance is a liquid substance.

27. A method as defined in claim 26, wherein said second recovery means comprises a second tank means, a second return pump means and second conduit means connecting said second suction box means to said second tank means, said second tank means to said second pump means and said second pump means to said second applicator means, said second tank means being further connected to an external supply of liquid substance, whereby the liquid substance recuperated by said second suction box means is first conveyed into said second tank means with the external supply being adapted to maintain in said second tank means a constant level, the liquid substance being then conveyed by said second pump means from said second tank means to said second applicator means.

28. A method as defined in claim 18, wherein said second applicator means comprises a second applicator roll contacting said second side of said web, and a second metering and distributing means for supplying a desired amount of the substance to said second applicator roll.

29. A method as defined in claim 28, wherein said second metering and distributing means comprises a second pair of parallel and horizontal rolls in contact with one another, with one of said second pair of rolls contacting said second applicator roll, whereby the substance for said second applicator means is supplied from the top in a second wedge-shaped channel formed by said second pair of rolls.

30. A method as defined in claim 29, wherein the substance is a liquid substance.

31. A method as defined in claim 18, wherein said first transfer means comprises a pick-up roll with said second fabric means passing therearound, said pick-up roll being parallel to said first couch roll means and being located adjacent thereto in order that a plane passing substantially through the axes of said first couch roll means and said pick-up roll intersects said first and second fabric means and said web as said web is substantially tangential to said first and second fabric means when said web is being transferred from said first to said second fabric means.

32. A method as defined in claim 31, wherein in step h, said web diverging from said second couch roll means is transferred on a third web conveying porous fabric means by way of a second transfer means in a way similar to the transfer of said web from said first to said second fabric means by way of said first transfer means.

33. A method as defined in claim 32, wherein said first, second and third fabric means each form an endless web conveying means.

34. A method as defined in claim 32, wherein the substance is a liquid coating, whereby said web is coated on both sides thereof with said coating.

35. A method as defined in claim 32, wherein said first and second sides of said web are respectively the top and bottom sides thereof, whereby said web is deposited over said first and third fabric means in steps a and h respectively and under said second fabric means in step c, said first and second applicator means applying the substance respectively on said top and bottom sides of said web with said first and second couch roll means drawing the substance through said wet web thereby respectively coating by the filtering effect of said web said top and bottom sides thereof.

36. A method as defined in claim 35, wherein in step a, said wet web is formed of a suspension of fibers deposited on said first fabric means with excess water being drained off as much as possible from said web through said first fabric means at a location rearwards of said first couch roll means.

* * * * *